United States Patent [19]

Nakano

[11] Patent Number: 4,926,484

[45] Date of Patent: May 15, 1990

[54] CIRCUIT FOR DETERMINING THAT AN AUDIO SIGNAL IS EITHER SPEECH OR NON-SPEECH

[75] Inventor: Yoshitomo Nakano, Tokyo, Japan

[73] Assignee: Sony Corporation, Tokyo, Japan

[21] Appl. No.: 262,581

[22] Filed: Oct. 26, 1988

[30] Foreign Application Priority Data

Nov. 13, 1987 [JP] Japan ..... 62-286764

[51] Int. Cl.[5] ..... H04R 29/00

[52] U.S. Cl. ..... 381/56; 381/46; 381/110

[58] Field of Search ..... 379/80, 81, 351; 381/46, 56, 110

[56] References Cited

U.S. PATENT DOCUMENTS 3,832,491 8/1974 Sciulli et al. ..... 381/46
4,008,375 2/1977 Lanier ..... 381/46
4,433,435 2/1984 David ..... 381/110
4,449,190 5/1984 Flanagan et al. ..... 381/46
4,542,525 9/1985 Hopf ..... 381/56
4,696,041 9/1987 Sakata ..... 381/46
4,700,392 10/1987 Kato et al. ..... 381/46

*Primary Examiner*—Forester W. Isen
*Attorney, Agent, or Firm*—Lewis H. Eslinger; Jay H. Maioli

[57] ABSTRACT

A threshold level for determining whether an input audio signal is a speech or non-speech signal in a voice operated recorder is changed in accordance with the ratio of the non-speech duration of the input audio signal to a predetermined period of time so as to decrease the influence of ambient noise on the judgement between speech and non-speech signals as made by the voice operated recorder.

11 Claims, 4 Drawing Sheets

TOT NON-SPEECH DURATION DOES NOT REACH 3 SEC WITHIN BOTH 30 SEC AND 60 SEC

TOT NON-SPEECH DURATION EXCEEDS 3 SEC BETW 30 SEC AND 60 SEC

TOT NON-SPEECH DURATION EXCEEDS 3 SEC WITHIN 30 SEC 1
2
3
MIC
4
5
DIGITAL SIGNAL PROC(ADM)
6
MEM
7
8
9
SYS CONT
ST
CK
10
11
LCH
12
LCH
LCH
LO or LO
13
CNTR
14
CNTR
15
16'
17
FLTR
18
22
Vs
Ss
Vc1
Vc2
SA1
SA2
SD
L1
L2

CIRCUIT FOR DETERMINING THAT AN AUDIO SIGNAL IS EITHER SPEECH OR NON-SPEECH

BACKGROUND OF THE INVENTION

1. Field of the Invention

This invention relates generally to a circuit for distinguishing between speech and non-speech signals and, more particularly, to a circuit for use in a recording/reproducing apparatus that is voice controlled.

2. Description of the Prior Art

In a recording/reproducing apparatus using a magnetic tape, a solid-state memory, a magnetic disk, or the like, as a recording medium, it is known to conserve the space available on the recording medium by automatically setting a recording mode to record speech signals only when a person is actually speaking. These recorders are known as voice actuated or voice operated recorders and applications for such recording/reproducing apparatus are an automatic telephone answering machine, a memory machine, a transcription machine, and the like. In the apparatus to be voice controlled, a circuit for distinguishing between speech and non-speech signals, that is, which judges the presence/absence of an input speech signal, is typically employed.

A conventional speech/non-speech signal judging circuit compares the level of an input speech signal with a predetermined threshold level, determines that the speech signal is a non-speech signal when the speech signal is lower than the threshold level, and determines it to be a speech signal when it exceeds the threshold level.

In the conventional speech/non-speech signal judging circuit, however, the threshold level for distinguishing between speech and non-speech signals is fixed at a predetermined value. Therefore, when there is a large, steady, noise disturbance, such as unusual ambient noise picked up by a microphone or a telephone or a telephone line, even if the user does not speak, the noise level exceeds the predetermined threshold level and the presence of a speech signal is erroneously detected. As a result, the recording/reproducing apparatus is undesirably set in the recording state and this disturbance noise is erroneously recorded, thereby decreasing the utilization rate of the recording medium and defeating one of the original purposes of the voice actuated recorder.

This problem can be particularly troublesome in an automatic telephone answering apparatus wherein the telephone line is disengaged by detecting a non-speech signal, that is, the absence of speech, upon completion of a message from a caller. If a detection error is caused by noise, the telephone line will be kept DC-engaged even after the message is completed. For this reason, in addition to wasting the available space on the recording medium, the automatic telephone answering apparatus cannot prepare for the next incoming call because the telephone line has been incorrectly kept engaged.

In the Voice Operational Recording (VOR) mode of a dictating or transcription machine, the recording state can also be automatically started by a large noise disturbance, and the recording state will unnecessarily continue. As a result, an actual input speech signal may not be able to be recorded because the recording medium has been used up.

OBJECTS AND SUMMARY OF THE INVENTION

Accordingly, it is an object of the present invention to provide a recording/reproducing apparatus that is actuated in the recording mode by speech signals that can eliminate the above-noted defects inherent in the prior art.

Another object of the present invention is to provide a speech/non-speech signal determination circuit in which a speech/non-speech signal threshold level is altered in accordance with the ratio of the duration of a non-speech input signal to a predetermined time.

A further object of the present invention is to provide a speech/non-speech signal determination circuit in which when the total non-speech duration within a predetermined time period is sensed to be short, it is determined that a long and steady noise that exceeds the existing judging level is present, and the speech/non-speech signal threshold or judging level is raised, whereas when the total non-speech duration is long, it is determined that a steady noise disturbance is not present and the threshold level is maintained, thereby accurately discriminating between speech and non-speech signals regardless of the presence of noise.

BRIEF DESCRIPTION O OF THE DRAWINGS

DETAILED DESCRIPTION OF THE PREFERRED EMBODIMENTS

Figure 1:
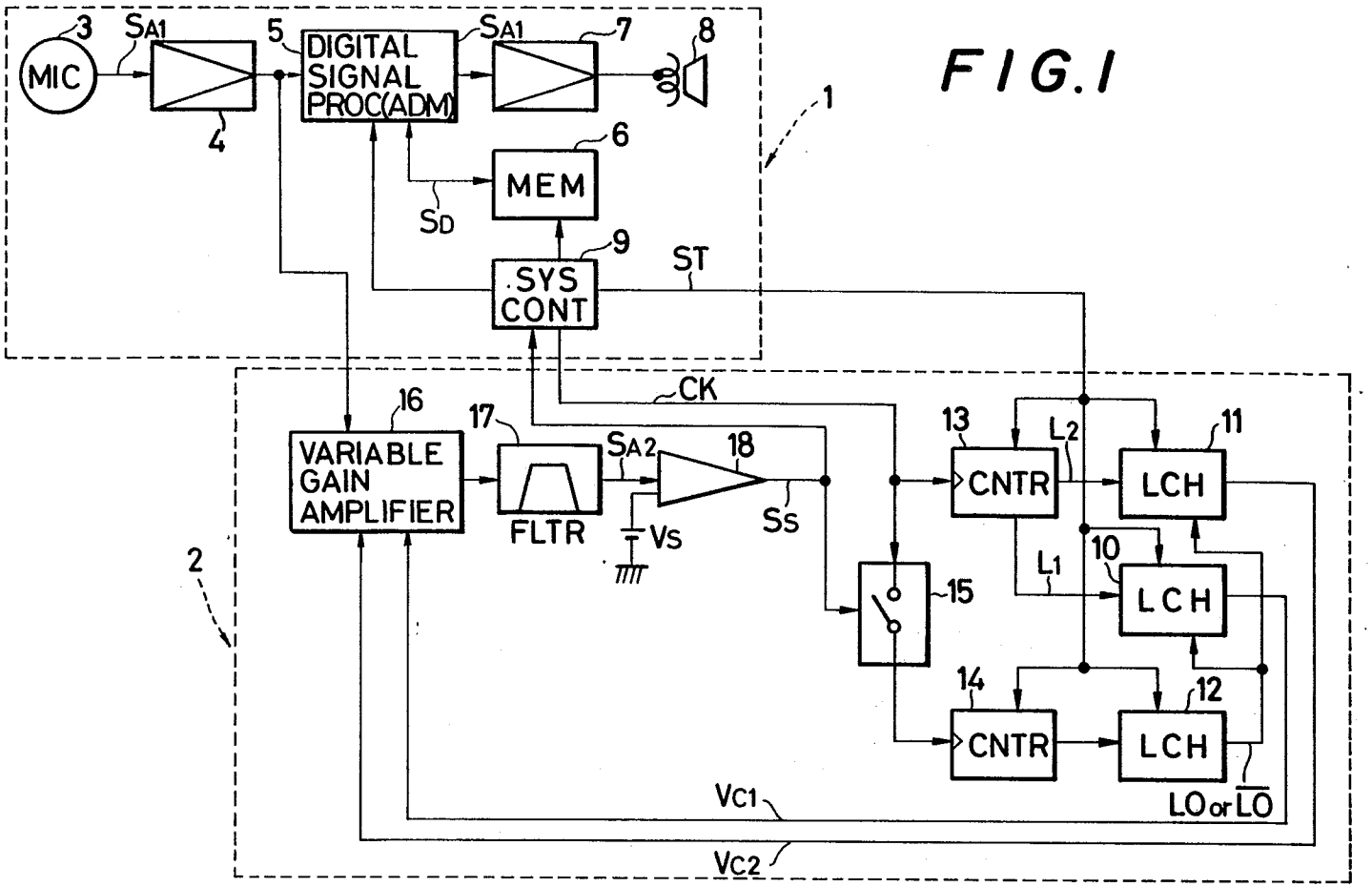
FIG. 1 is a schematic in block diagram form of an embodiment of the present invention.

In the embodiment of FIG. 1 the present invention is applied to a digital recording/reproducing apparatus employing a solid-state memory as a recording medium. The system shown in FIG. 1 is divided into a recording/reproducing section 1 and a speech/non-speech signal determination circuit section 2. When recording/reproducing section 1 is in a recording mode an input speech (analog) signal $S_{A1}$ obtained from a microphone 3 is raised in signal level by an input amplifier 4. The amplified signal is supplied to a digital signal processing circuit 5 where it is converted into a digital signal. In this embodiment, the speech signal $S_{A1}$ is subjected to the well-known adaptive delta modulation (ADM) processing and is converted into a one-bit digital speech signal $S_D$. The signal $S_D$ is then recorded in a memory 6 that is constituted by a semiconductor memory or the like.

In a reproducing mode, the signal $S_D$ is read out from memory 6 and demodulated into the original analog signal $S_{A1}$ by digital signal processing circuit 5. The reproduced analog signal $S_{A1}$ is amplified by an output amplifier 7 and fed to a loudspeaker 8. A system controller 9 controls the operation of the processing circuit 5, as well as other circuits in the apparatus at predetermined timings in the recording and reproducing modes.

In the recording mode, the output signal from input amplifier 4 is also supplied to speech/non-speech signal determination circuit section 2 and is subjected therein to speech/non-speech signal determination, as will be described later. In accordance with this determination, only the input digital signal $S_D$ that is determined to be of a speech duration is written in memory 6 under the control of system controller 9.

In the operation of the speech/non/speech judging circuit section 2, when a total non-speech duration as determined by a predetermined speech/non-speech signal threshold level is less than three seconds, within a first interval of 30 seconds from the start of recording, that is, if the sum of the speech duration of a user as determined by the threshold level and the duration of the noise is long, it is determined that what is actually being recorded is noise that has continued for a long period of time. As a result, the threshold level is effectively raised by one step so as to decrease the sensitivity to noise, thereby detecting only speech from the user. It will be appreciated, of course, that the time periods above are given by way of example only and many other time periods could be advantageously employed.

In addition, if the total non-speech duration determined by the threshold level that has just been raised by one step is less than three seconds within the next 30 seconds following the interval of 30 seconds from the start of recording, it is determined that the undesirable noise has continued for a longer period of time. As a result, the threshold level is raised by another step so as to further decrease sensitivity to noise, thereby detecting only speech from the user. Thereafter, the threshold level is kept unchanged.

Moreover, if the total non-speech duration is less than three seconds within an interval of 30 seconds from the start of recording but it exceeds three seconds within an interval of 60 seconds from the start of recording, the threshold level is raised when the first interval of 30 seconds has elapsed, so as to detect only speech from the user. Thereafter, the threshold level is kept unchanged.

According to the above-described operation, when a total non-speech duration judged within a predetermined period of time is less than a set value (three seconds in this embodiment), the threshold level is raised by determining that a large disturbance noise is present. Therefore, only speech from the user can be detected and erroneous operation and consumption of the available memory due to noise can be prevented.

The speech/non-speech signal determination circuit section 2 will be described in detail below with reference to FIG. 1. When recording/reproducing section 1 is set in the recording mode, system controller 9 outputs a recording start signal ST, and in response to this signal ST, latch circuits 10, 11, and 12 are set, while counters 13 and 14 are reset. In addition, system controller 9 outputs a clock signal CK having a predetermined frequency that is supplied to counter 13 to be counted therein. Clock signal CK is also fed to the input side of a switch 15. Initially, the gain of a variable gain amplifier 16 to which the output signal from input amplifier 4 is supplied is set to a maximum value.

When recording commences, the output signal from input amplifier 4 is amplified by variable gain amplifier 16 using its maximum gain, and the amplified signal is filtered by a band-pass filter 17, so that a signal $S_{A2}$ having frequencies only in the speech band is passed thereby. The level of this signal $S_{A2}$ is compared with a predetermined threshold level $V_S$ in a comparator 18, so that speech/non-speech signal determination is performed. A signal $S_S$ representing the result of this determination is supplied to system controller 9 and to control the operation of switch 15.

When the determination result indicated by signal $S_S$ is "non-speech signal", system controller 9 stops writing data obtained from digital signal processing circuit 5 in memory 6. At the same time, switch 15 is closed by signal $S_S$ and the clock signal CK from system controller 9 is supplied to counter 14 through switch 15. Consequently, counter 14 measures the total time duration of the non-speech signal. In this embodiment the maximum measurement time in counter 14 is set to be three seconds.

When counter 13 has counted the clock pulses in clock signal CK for 30 seconds from the start of recording, it outputs a 30-second latch trigger signal $L_1$ to latch circuit 10 and when counter 13 has counted clock pulses CK for 60 seconds from the start of recording, it outputs a 60-second latch trigger signal $L_2$ to latch circuit 11. Note that counter 13 always receives and counts the pulses in clock signal CK, whereas counter 14 only counts such clock pulses during the time when it is determined that a non-speech signal is present in response to comparator 18.

In addition, latch circuit 12 latches the measurement result from counter 14, that is, the indication whether the total non-speech duration from the start of recording has reached three seconds or not, and latch circuits 10 and 11 latch an output LO or $\overline{LO}$ from latch circuit 12. In this embodiment, the output LO represents that the measurement result from counter 14 is less than three seconds, whereas the output $\overline{LO}$ represents that such measurement exceeds three seconds. Output signals $V_{C1}$ and $V_{C2}$ from latch circuits 10 and 11, respectively, are gain control signals for controlling variable gain amplifier 16.

Figure 2A:
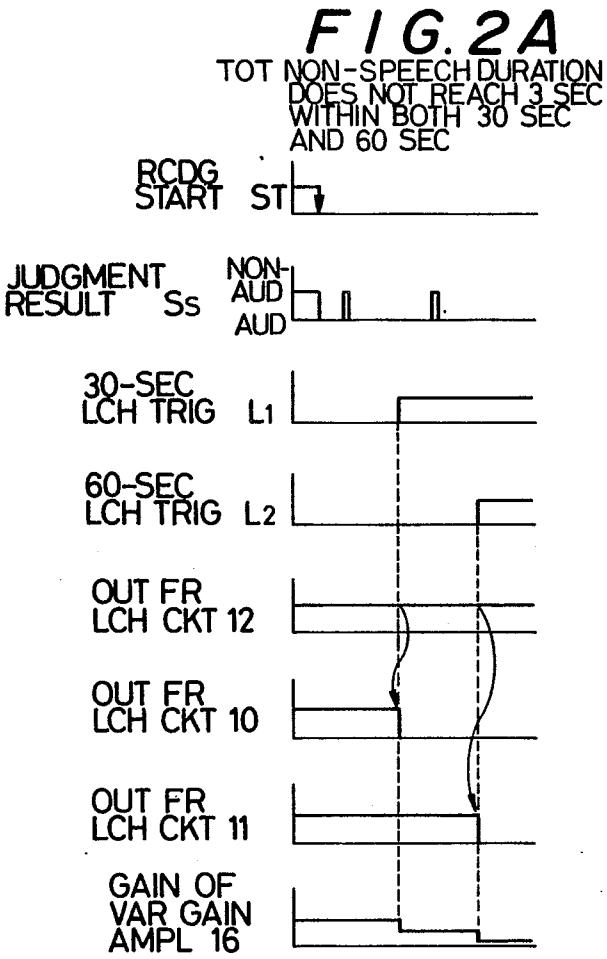
FIGS. 2A–2C are timing charts useful in explaining the operation of the circuit of FIG. 1.
Figure 2B:
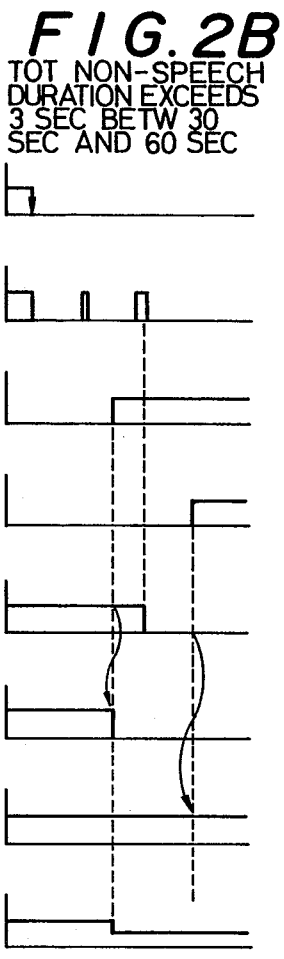
Figure 2C:
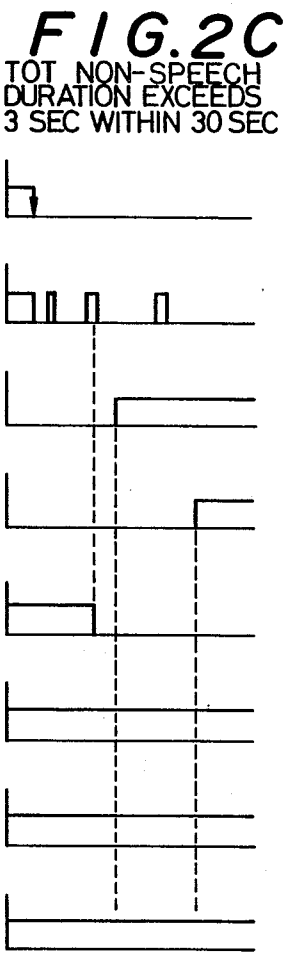

Examples of the operation of the system of FIG. 1 are shown in FIGS. 2A–2C. More specifically, in FIG. 2A because the measurement result of the non-speech duration from counter 14 does not total three seconds in the first 30 seconds from the commencement of recording, the signal LO is output from latch circuit 12 and counter 13 outputs the 30-second latch trigger signal $L_1$. Latch circuit 10 latches the output signal LO from latch 12, and outputs the corresponding signal $V_{C1}$ to variable gain amplifier 16 to decrease its gain by one step. In this embodiment, one step of decreasing gain is set to be approximately 3dB.

Because the measured result of the duration of non-speech sound still does not total three seconds within the next 30 second period, the signal LO is output once again from latch circuit 12. Then, counter 13 outputs the 60-second latch trigger $L_2$ to latch circuit 11, and latch circuit 11 latches the output signal LO and produces the signal $V_{C2}$ fed to variable gain amplifier 16, thereby decreasing the gain by another step, preferably 3dB.

Thus, because the gain of variable gain amplifier 16 is decreased in the above-described manner, the predetermined threshold level of the comparator 18 is effectively raised by two steps.

FIG. 2B represents another example, in which because the measured total duration of non-speech signal does not total three seconds within the first 30 seconds following commencement of recording, the output signal LO is output from latch circuit 12. As a result, the signal $V_{C1}$ is produced by latch circuit 10 on the basis of the 30-second latch trigger signal $L_1$, and the gain of variable amplifier 16 is decreased by one step. Thus, the threshold level of comparator 18 is effectively raised by one step (3dB).

Because the measured total duration of non-speech signals does exceed three seconds within the next successive 30 seconds, the output signal $\overline{LO}$ is output from latch circuit 12. Latch circuit 11 then latches the output signal LO in response to the 60-second trigger $L_2$ from counter 13, the signal $V_{C2}$ is not produced, and the gain of variable gain amplifier 16 remains unchanged. That is, the gain is held decreased by only one step. Therefore, the threshold level $V_S$ of comparator 18 is effectively held increased by only one step (3dB).

FIG. 2C represents another example, in which because the measured total duration of non-speech signal exceeds three seconds within the first 30 seconds, the output signal LO is produced by latch circuit 12. Therefore, because latch circuit 10 latches the output $\overline{LO}$ in response to the 30-second latch trigger $L_1$ from counter 13, the signal $V_{C1}$ is not produced, and the gain of variable gain amplifier 16 is maintained unchanged at its original maximum level.

Because latch circuit 11 latches the output signal $\overline{LO}$ in response to the 60-second latch trigger $L_2$ from counter 13 even after the next 30 seconds have elapsed, the signal $V_{C2}$ cannot be produced, and variable gain amplifier 16 continues to hold the original maximum gain. Therefore, the threshold level $V_S$ of comparator 18 remains substantially unchanged.

Figure 3:
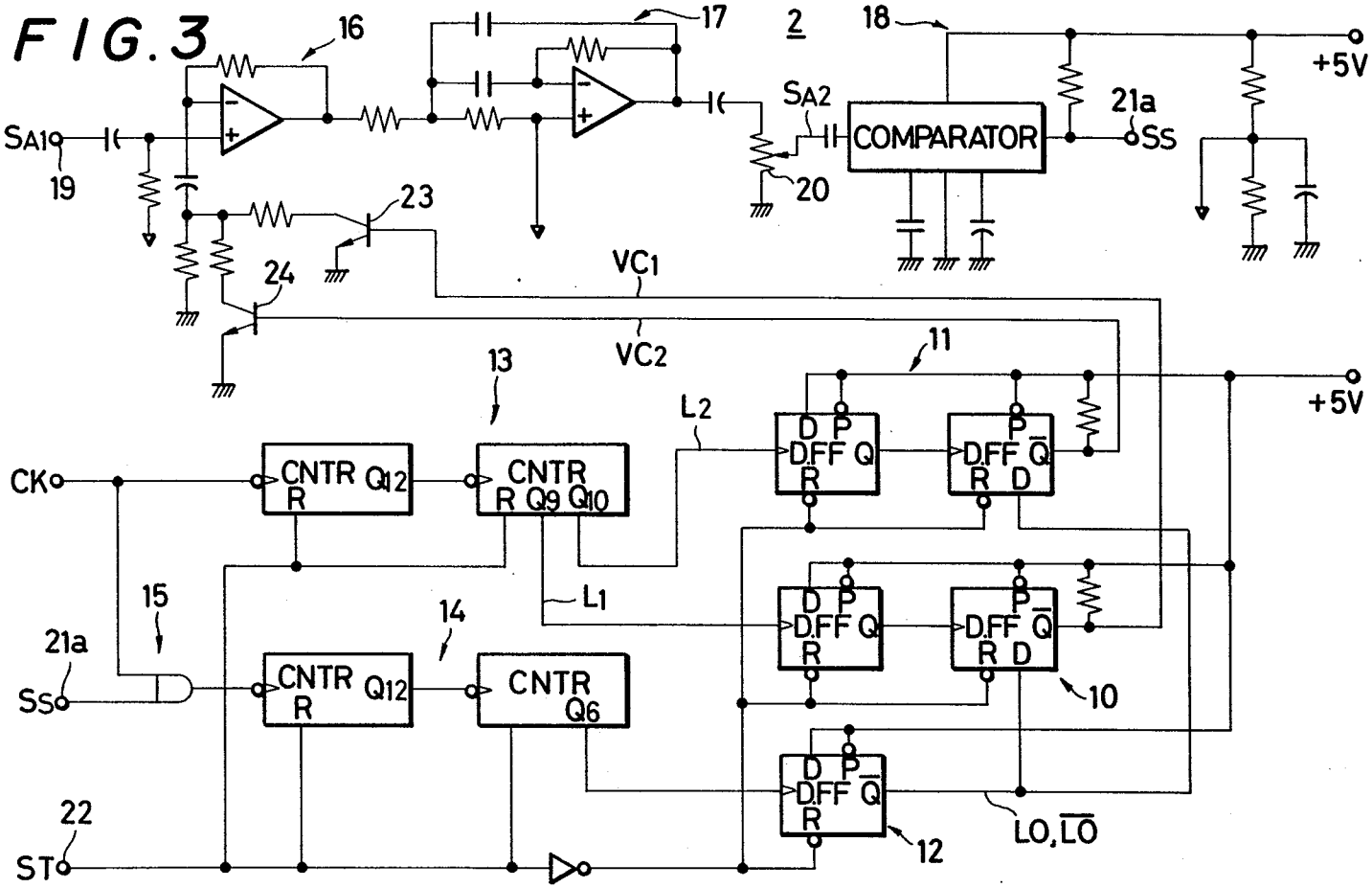
FIG. 3 is a circuit diagram showing the circuit of FIG. 1 in more detail.

FIG. 3 shows a detailed circuit arrangement of the speech/non-speech signal determination circuit 2 of FIG. 1. The same reference numerals in FIG. 3 denote the same part as in FIG. 1. In FIG. 3 the audio signal $S_{A1}$ amplified by input amplifier 4, shown in FIG. 1 but not in FIG. 3, is supplied to an input terminal 19. The initial gain of the signal $S_{A1}$ is set by a variable resistor 20 after passing through variable gain amplifier 16 and band-pass filter 17. Then, the signal $S_{A1}$ is supplied to comparator 18 and the comparison result $S_S$ obtained by comparator 18 is output at terminal **21*a* and is supplied to an AND gate, which constitutes switch 15 in FIG. 1. Terminals 21*a* are not shown to be connected in FIG. 3** in the interest of schematic neatness but it should be understood that these terminals are electrically the same point.

In addition, the recording start signal ST is supplied from system controller 9, shown in FIG. 1, to an input terminal 22. In response to signal ST, counter 14 is reset and latch circuits 10, 11, and 12 are set in predetermined states. These latch circuits 10, 11, and 12 are constituted by D flip-flops in this embodiment. The outputs signals LO and LO from latch circuit 12 are latched by latch circuits 10 and 11, respectively. The output signal $V_{C1}$ and $V_{C2}$ from latch circuit 10 are supplied to the bases of transistors 23 and 24, respectively, for controlling the gain of variable gain amplifier 16.

Figure 4:
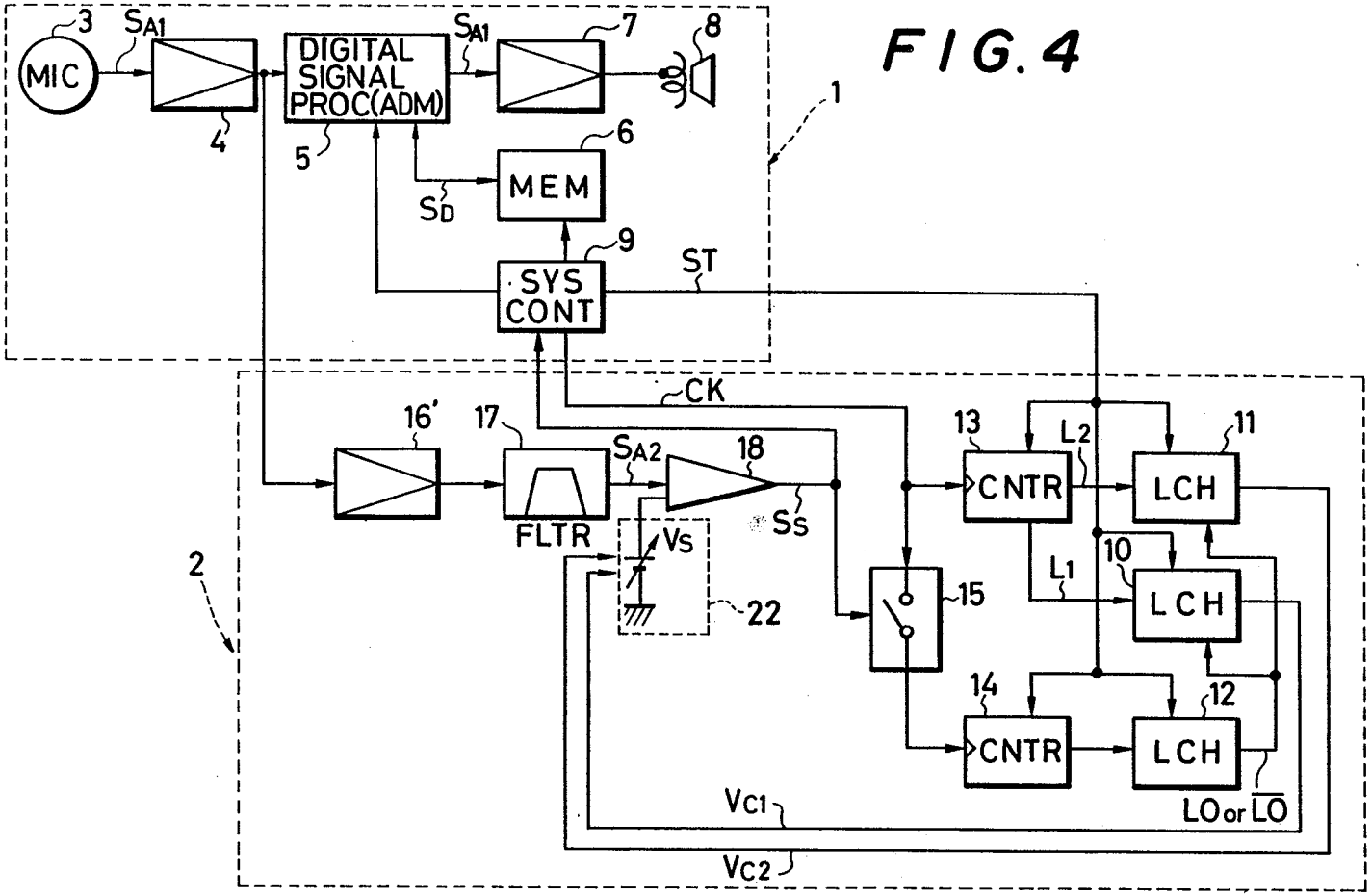
FIG. 4 is a schematic in block diagram form of another embodiment of the present invention.

In the above-described embodiment, the gain of variable gain amplifier 16 is controlled by the gain control signals $V_{C1}$ and $V_{C2}$. According to another embodiment shown in FIG. 4, however, the threshold level $V_S$ of comparator 18 may be directly controlled at a variable voltage source by signals $V_{C1}$ and $V_{C2}$. In that case amplifier 16' need not be a variable gain amplifier. The threshold level $V_S$ can be easily changed using a transistor switched voltage divider or a switched multi-voltage source, all of which are well known to the artisan.

Furthermore, although in this embodiment the speech/non-speech signal threshold level is raised or maintained depending on whether a total non-speech duration within 30 or 60 seconds from the start of recording reaches a set value (three seconds) the level could also be lowered. In addition, the non-speech signal duration within a predetermined period of time may be measured at least once in the course of recording so that the speech/non-speech signal level is raised, lowered, or maintained depending on whether the non-speech duration reaches the set value or not. Moreover, the speech/non-speech signal threshold level may be further fine-controlled by increasing the number of time latch triggers such as the 30-second and 60-second latch triggers $L_1$ and $L_2$ from the latch circuits, and setting the predetermined time to be 10 seconds, 15 seconds, or the like.

The processing described above can also be performed by a microcomputer, and elements such as the counters and the latch circuit can be integrated in the microcomputer.

The present invention can be applied not only to digital recording/reproducing apparatus but also to recording/reproducing apparatus using magnetic tapes, magnetic disks, and the like.

The above description is given on a single preferred embodiment of the invention, but it will be apparent that many modifications and variations could be effected by one skilled in the art without departing from the spirit or scope of the novel concepts of the invention, which should be determined by the appended claims.

What is claimed is:

1. A circuit for distinguishing between speech and non-speech signals for judging an input audio signal to be a non-speech signal when a level of the input audio signal is lower than a predetermined level and judging the input audio signal to be a speech signal when the level of the input audio signal is higher than the predetermined level, comprising:

a comparator for comparing the level of the input audio signal with the predetermined level; and level changing control means for raising or lowering the predetermined level by a predetermined amount in accordance wit a ratio of a total non-speech time duration of the input audio signal to a time period having a value equal to a predetermined constant.

2. A circuit according to claim 1, wherein said level changing control means comprises:

first counter means for counting a total non-speech time duration and producing an output in accordance with an output from said comparator;

second counter means for counting the time of the input audio signal and producing an output signal when a period of time having a value equal to said predetermined constant has elapsed; and control signal generating means for outputting a control signal for altering the level of said comparator by a predetermined amount in response to the output from said first and second counter means.

3. A circuit according to claim 2, wherein said control signal generating means comprises:

first latch means for latching the output from said first counter means and outputting the latched output depending on whether the total non-speech duration exceeds the period of time having a value equal to said predetermined constant; and second latch means for latching the output from said second counter means and outputting a control signal for altering the judging level of said comparator by the predetermined amount in response to the output from said first latch means.

4. A circuit according to claim 2, wherein a plurality of periods of time are set each having a value equal to said predetermined constant, and said second counter means counts the input time of the input audio signal and produces an output signal when each period of time having a value equal to said predetermined constant has elapsed.

5. A circuit for distinguishing between speech and non-speech signals for judging an input audio signal to be a non-speech signal when a level of the input audio signal is lower than a predetermined level and judging the input audio signal to be a speech signal when the level of the input audio signal is higher than the predetermined level, comprising:

a comparator for comparing the level of the input audio signal with the predetermined level; and level changing control means for raising or lowering the predetermined judging level by a predetermined amount in accordance with a ratio of a non-speech time duration of the input audio signal to a predetermined time;

wherein said level changing control means comprises:

first counter means for counting a total non-speech time duration and producing an output in accordance with an output from said comparator;

second counter means for counting the time of the input audio signal and producing an output signal when a predetermined period of time has elapsed; and control signal generating means for outputting a control signal for altering the level of said comparator by a predetermined amount in response to the outputs from said first and second counter means;

wherein said control signal generating means comprises:

first latch means for latching the output from said first counter means and outputting the latched output depending on whether the total non-speech duration exceeds the predetermined period of time; and second latch means for latching the output from said second counter means and outputting a control signal for altering the judging level of said comparator by the predetermined amount in response to the output from said first latch means;

wherein said second latch means comprises a plurality of latch circuits for respectively latching a plurality of outputs from said second counter means.

6. A circuit for distinguishing between speech and non-speech signals for judging an input audio signal to be a non-speech signal when a level of the input audio signal is lower than a predetermined level and judging the input audio signal to be a speech signal when the level of the input audio signal is higher than the predetermined level, comprising:

a comparator for comparing the level of the input audio signal with the predetermined level; and level changing control means for raising or lowering a level of the input audio signal input to said comparator by a predetermined amount in accordance with a ratio of a non-speech time duration of the input audio signal to a predetermined time.

7. A circuit according to claim 6, wherein said level changing control means comprises:

first counter means for counting a total non-speech duration and producing an output in accordance with an output from said comparator;

second counter means for counting the input time of the input audio signal and producing an output signal when a predetermined period of time is elapsed; and control signal generating means for producing a control signal for changing the level of the input audio signal input to said comparator by a predetermined amount in response to the outpts from said first and second counter means.

8. A circuit according to claim 7, wherein said control signal generating means comprises:

first latch means for latching the output from said first counter means and producing a latched output when the total non-speech duration exceeds the predetermined period of time; and second latch means for latching the output from said second counter means and producing a control signal for changing the level of the input audio signal input to said comparator by a predetermined amount in response to the output from said first latch means.

9. A circuit according to claim 7, wherein a plurality of predetermined periods of time are set, and said second counter means counts the input time of the input audio signal and produces an output signal when each predetermined period of time is elapsed.

10. A circuit according to claim 9 wherein said second latch means comprises a plurality of latch circuits for respectively latching a plurality of outputs from said second counter means.

11. A circuit according to claim 6, wherein the input audio signal is passed through a variable gain amplifier before being input to said comparator, and said level changing control means raises or lowers the level of the input audio signal by the predetermined amount by controlling the gain of said variable gain amplifier.

* * * * *

UNITED STATES PATENT AND TRADEMARK OFFICE

CERTIFICATE OF CORRECTION

PATENT NO. : 4,926,484

DATED : May 15, 1990

INVENTOR(S) : Yoshitomo Nakamo

It is certified that error appears in the above-identified patent and that said Letters Patent is hereby corrected as shown below:

IN CLAIMS:

Col. 6, line 40, change "wit" to --with--

Col. 8, line 23, change "outpts" to --outputs-- line 42, after "claim 9" insert --,--

Signed and Sealed this

Sixteenth Day of July, 1991

*Attest:*

*Attesting Officer*

HARRY F. MANBECK, JR.

*Commissioner of Patents and Trademarks*